US008747093B2

(12) United States Patent
Lin et al.

(10) Patent No.: US 8,747,093 B2
(45) Date of Patent: Jun. 10, 2014

(54) ELECTROSTATIC SPINNING ASSEMBLY

(75) Inventors: Tong Lin, Grovedale (AU); Xungai Wang, Highton (AU); Xin Wang, Highton (AU); Haitao Niu, Highton (AU)

(73) Assignee: Deakin University, Geelong, Victoria (AU)

( * ) Notice: Subject to any disclaimer, the term of this patent is extended or adjusted under 35 U.S.C. 154(b) by 543 days.

(21) Appl. No.: 13/124,742

(22) PCT Filed: Oct. 14, 2009

(86) PCT No.: PCT/AU2009/001373

§ 371 (c)(1),
(2), (4) Date: Sep. 12, 2011

(87) PCT Pub. No.: WO2010/043002

PCT Pub. Date: Apr. 22, 2010

(65) Prior Publication Data

US 2011/0311671 A1 Dec. 22, 2011

(30) Foreign Application Priority Data

Oct. 17, 2008 (AU) ..... 2008905358

(51) Int. Cl.
*D01D 5/08* (2006.01)

(52) U.S. Cl.
USPC ..... 425/174.8 E; 425/174; 425/174.6; 425/174.8 R; 425/83.1; 425/66; 264/10; 264/484; 264/172.16; 264/172.17; 264/405

(58) Field of Classification Search
USPC ..... 425/66, 83.1, 174, 174.6, 174.8 E, 425/174.8 R; 264/10, 484, 172.16, 172.17, 264/405
See application file for complete search history.

(56) References Cited

U.S. PATENT DOCUMENTS

| | | | | |
|---|---|---|---|---|
| 2,777,784 | A | 1/1957 | Miller | |
| 3,994,258 | A | 11/1976 | Simm | |
| 4,043,331 | A | 8/1977 | Martin | |
| 4,143,196 | A | 3/1979 | Simm | |
| 2004/0096532 | A1 * | 5/2004 | Dubson et al. | 425/115 |
| 2006/0290031 | A1 * | 12/2006 | Jirsak et al. | 264/465 |
| 2008/0150197 | A1 * | 6/2008 | Chang et al. | 264/465 |
| 2009/0148547 | A1 * | 6/2009 | Petras et al. | 425/174.8 E |
| 2009/0199717 | A1 * | 8/2009 | Green et al. | 96/12 |

FOREIGN PATENT DOCUMENTS

| | | | |
|---|---|---|---|
| WO | WO2005024101 | A1 | 3/2005 |
| WO | WO2006131081 | A1 | 12/2006 |

OTHER PUBLICATIONS

International Report on Patentability; International Search Report—PCT/AU2009/001373.

* cited by examiner

*Primary Examiner* — Timothy Kennedy
(74) *Attorney, Agent, or Firm* — Renner Kenner; Arthur M. Reginelli

(57) ABSTRACT

A spinneret for producing nanofibers from a viscous liquid using electrostatic spinning in an electric field is described. The spinneret includes one or more narrow annular bodies radially centered about and axially spaced along a central axis. The annular bodies may be discs, rings, or coils.

14 Claims, 14 Drawing Sheets

ELECTROSTATIC SPINNING ASSEMBLY

FIELD OF THE INVENTION

The present invention generally relates to an electrostatic spinning assembly for the production of nanofibres from viscous liquids such as polymer solutions, sol-gel, particulate suspension or melt and a method of using this assembly to produce nanofibres.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Conventional electrostatic spinning systems consist of a hollow needle spinneret, a pump for feeding the polymer solution through to the spinneret, an electrode collector plate and a high voltage power supply connected between the spinneret and the collector plate. The polymer liquid is fed to the spinneret, and charged with a high voltage. The resulting electrostatic force between the spinneret and the collector plate draws the solution into a Taylor cone. If the liquid has sufficient cohesion, the liquid is drawn out as a jet. Interaction between the jet, the external electric field and charge repulsion inside the jet causes the jet to bend and spin and therefore stretch thinner. Solvent evaporation causes the jet to solidify and be randomly deposited on the collector plate to form a non-woven nanofibre mat.

However, this production system provides limited fibre productivity as each spinneret only generates a single polymer jet producing up to 300 milligram of fibre per hour per needle. The small needle diameter also results in a highly concentrated electric field near the spinneret surface which is susceptible to corona discharge under a high applied voltage. The voltage is therefore generally restricted to below 30 kV. The low operating voltage also leads to coarse nanofibres.

The rate of production of nanofibres can be increased by electrostatically generating nanofibres from a broad liquid surface. For example, International patent publication WO2005024101 discloses an electrospinning device including a spinning cylindrical electrode (or "spinneret") that is partially immersed in a reservoir of polymer solution. A counter electrode is located a distance away from the cylindrical electrode. The polymer solution is carried as a thin film from the reservoir on the surface of the cylinder into the electric field between the spinning and collecting electrode. Nanofibres are created at certain points on the surface when the electrostatic field intensity between the electrodes is sufficient to draw the solution into a Taylor cone. The resultant nanofibres are randomly deposited on the counter electrode to form a non-woven nanofibre mat.

The formation of jets and resultant fibre morphology in these types of large scale electrospinning arrangements is highly influenced by the electric field intensity around the spinneret and the electric field intensity profile in the electrospinning zone. For example, the length of cylindrically shaped electrodes influences the quantity and critical voltage required to produce jets across the entire surface of the cylinder. At some voltages, jets are only produced at the ends of the cylinder. The thickness of the nanofibres produced over the length of the cylinder can also vary due to variations in the electric field intensity along that length.

It would therefore be desirable to provide an alternate spinneret for an electrostatic spinning device for production of nanofibres that address one or more of the above disadvantages.

SUMMARY OF THE INVENTION

According to a first aspect of the present invention, there is provided a spinneret for producing nanofibres from a viscous liquid using electrostatic spinning in an electric field, the spinneret including one or more narrow annular bodies radially centred about and axially spaced along a central axis.

The spinneret according to this first aspect of the present invention is formed from one or more narrow annular bodies. In the context of the present specification, narrow annular bodies generally refer to annular bodies having a ratio of width (or thickness) to diameter of less than 1:3, preferably less than 1:5 and more preferably less than 1:10. This narrow width is thought to produce a higher electric field around the spinneret surface and have an electric field intensity profile in the electrospinning zone that is less dependent on the shape of the spinneret as compared to wider width bodies such as a cylinder. The formation of jets and resultant fibre morphology from these types of spinnerets should have advantages over the existing cylinder type spinnerets.

The annular body can have any suitable configuration. In some embodiments, the annular body comprise annular loops radially centred about and axially spaced along a central axis. These annular loops can be in the form of discrete annular rings or could be substantially integrally connected in the axial direction to form a helical coil.

Where the spinneret is a helical wire coil, liquid jets that form nanofibres can be created at certain areas on the curved surfaces of the wire loops during electrospinning when the electrostatic field intensity at that surface is sufficient to draw the solution into a Taylor cone. As indicated above, the wire loops of the coil comprise narrow annular bodies within the electric field which in some embodiments can be arranged to minimise and/or optimise the effect of adjoining loops on that electric field.

The helical wire coil used for the spinneret can have various configurations including tubular, conical, spherical, cubic, prismic or the like. Coils of these configurations can include a single annular loop for nanofibre production. However, it is preferred that the coil includes two, and preferably multiple annular loops axially spaced along the central axis of the coil. Multiple loops provide greater wire surface area for the production of a plurality of liquid jets compared to a single loop. Two or more of the annular loops of the coil may be spaced apart, preferably by a distance greater than the diameter of the wire. Additionally or alternatively, two or more annular loops of the coil may be closely spaced together. Each of the annular loops may have a similar wire diameter and/or loop diameter, or these dimensions may vary between loops. For example, in some embodiments the average radius of the annular loops is between 5 and 1000 mm. In some embodiments, the length of the coil is greater than 20 mm, preferably between 20 and 6000 mm. In some embodiments, the diameter of the wire of the coil is between 0.5 mm and 200 mm, preferably between 0.7 and 50 mm.

In one embodiment, the annular loops form a substantially tubular shaped coil about the central axis of the spinneret. In this embodiment, it has been found that the end regions of a tubular shaped coil can reach a critical electric field intensity in an applied electric field before regions of the coil away from the ends. A more uniform electric field can be achieved across the length of the tubular coil by configuring the annular loops at and/or proximate the end of the tubular shaped coil with a smaller radius than the annular loops proximate the center of the tubular shaped coil. The tubular shaped coil can therefore have a substantially tapered profile at the end regions of the coil in some embodiments.

There is preferably a wide axial spacing between each adjacent annular loop of a tubular shaped coil along the central axis. This configuration preferably minimises the interaction each loop has on the electric field around an adjacent loop. The spacing ("d") between each loop can be adjusted separately, and the length of the coil, wire size, loop diameter and configuration of a counter electrode influence the electric field around the wire. In a preferred embodiment the spacing between adjacent annular loops is at least 1 mm, and preferably between 5 mm and 800 mm.

In other embodiments, the annular loops of the helical wire coil form a substantially conical shaped coil about the central axis. The conical shaped coil is preferably configured with a cone angle of between 90 to 140°, and more preferably between 110 to 130°. In this embodiment, each annular loop can be spaced closely to an adjacent annular loop relative to the central axis to form a small aperture between each adjacent annular loop. The spacing between adjacent loops is preferably selected to enable surface forces of viscous liquid to substantially prevent that liquid flowing between the loops when an electric field between the spinneret and a counter electrode is less than a critical intensity. Liquid will generally be drawn between the loops when the electric field reaches the critical intensity due to the formation of liquid jets. The helical wire coil can form a liquid reservoir for the viscous liquid within the annular loops using this close spacing.

The coil loops of the spinneret are preferably constructed from both conductive and non-conductive materials. In one preferred form the loops of the spinneret are formed of copper, steel, aluminium metals. For the non-conductive material plastics such as (but not limited to) Acrylonitrile butadiene styrene, Polycarbonates, Polyamides, Polybutylene terephthalate, Polyethylene terephthalate, Polyphenylene oxide, Polysulphone, Polyetherketone, Polyetheretherketone, Polyimides, ceramic, wood can be used. No matter what type of material is used, the coil material is preferably substantially inert to (for example will not be dissolved by) the polymer solution used for electrospinning.

In yet other embodiments, the annular bodies comprise discs or rings radially centred about and axially spaced along a central axis. In some embodiments, the spinneret includes a mixture of discs and rings radially centred about and axially spaced along a central axis. During electrospinning using this embodiment of the spinneret, liquid jets that form nanofibres can be created at certain areas on the curved surfaces of the disc or rings when the electrostatic field intensity at that surface is sufficient to draw the solution into a Taylor cone. Again, the discs and/or rings form narrow annular bodies within the electric field which in some embodiments can be arranged to minimise and/or optimise the effect of adjoining discs or rings on that electric field.

Where the spinneret includes discs, those discs could comprise solid radial bodies, spoked bodies, bodies with cavities or the like.

For the discrete annular rings, a group of annular loops can be set in parallel along the axis to form a spinneret. In this case, the space between each loop, the spinneret length, wire diameter and loop radius all can be adjusted in a similar way as the helical wire coil.

The spinneret can include any desired number of discs or rings. In one embodiment, the spinneret includes a single disc or ring radially centred about and rotatable about the central axis. In other embodiments, the spinneret includes two or more discs radially centred about and rotatable about the central axis, each disc being axially spaced apart along the central axis. Where multiple discs or rings are used, it may be advantageous to use discs or rings at the end regions of the collection having a smaller radius than the discs or rings proximate the center of the collection of discs or rings. This may provide a more uniform electric field can be achieved across the length of the collection of discs or rings.

There is preferably a wide axial spacing between each adjacent disc and/or ring along the central axis of the spinneret. This configuration preferably minimises the interaction each disc or ring has on the electric field around an adjacent disc or ring. The spacing ("d") between each loop is dependent on the dimensions of each disc or ring, configuration of a counter electrode that is associated with the spinneret and other parameters. However, in a preferred embodiment the spacing between adjacent annular discs or rings is at least 1 mm, and preferably between 5 mm and 800 mm.

According to a second aspect of the present invention, there is provided an electrostatic spinning apparatus for producing nanofibres from a viscous liquid in an electric field comprising:

- a charged electrode including at least one spinneret according to the first aspect of the present invention;
- a counter electrode spaced apart from the charged electrode;
- a liquid reservoir for holding a viscous liquid, the reservoir being in liquid communication with at least one surface of the spinneret; and
- a power supply electrically connected between the charged electrode and the counter electrode, the power supply capable of electrically charging the charged electrode and supply a potential difference between the charged electrode and the counter electrode.

In this second aspect of the present invention, nanofibres are produced using the apparatus by coating a surface of the spinneret(s) with the viscous liquid, and using the power supply to create a potential difference between the viscous liquid and the counter electrode (the electrospinning zone). Liquid jets which form nanofibres are created at certain areas on the surface when the electrostatic field intensity in the electrospinning zone is sufficient to draw the solution into a Taylor cone.

The potential difference required to produce an electric field at or above the critical electric field intensity is dependent on a number of factors including spinneret and counter electrode size and configuration, the distance between the spinneret and counter electrode (the collecting distance), and the physical properties of the viscous liquid. Generally, for helical wire coils, the power supply is used to create a potential difference between the charged electrode and the counter electrode of greater than 30 kV, preferably greater than 40 kV, and more preferably greater than 60 kV. For a tubular coil spinneret, the applied voltage used is preferably between 40 to 80 kV. For a conical coil spinneret, the applied voltage used is preferably less than 70 kV. It has been found that corona discharge can in some cases occur for voltages above 70 kV for this coil configuration. For a disc or ring type spinneret, the applied voltage used is preferably greater than 40 kV.

The collecting distance, or spacing between the charged electrode and counter electrode can affect the electric field produced therebetween, the dimensions of the nanofibres produced by the apparatus, and the voltage required to produce the critical electric field intensity. Again, the spacing is dependent on a number of factors including spinneret and counter electrode size and configuration, potential difference and the composition of the viscous liquid. In some embodiments, the charged electrode is spaced apart from the counter electrode by between 100 to 600 mm.

The viscous liquids can be any liquid that can be electrospun in an electric field as nanofibres. Suitable viscous liquids include polymer solutions, sol-gel, particulate suspension and/or melts. In a preferred form, the viscous liquid is a polymer solution typically comprising at least one polymer and at least one volatile solvent. Polymer such as synthetic polymers, natural polymers and biomacromolecules, thermoplastic polymers and/or reactive polymers could be used as a viscous liquid for electrospinning. The solvent used is preferably determined by the solubility of polymer. In some embodiments, the solvent could include water, ethanol, chloroform, N,N-Dimethylformamide or another volatile liquid. The solvent is evaporated during electrospinning facilitating solidification of the liquid into a solid nanofibre.

The charged electrode of the electrostatic spinning apparatus may include two or more spinnerets. The additional spinnerets provide further fibre formation surfaces within the apparatus. Each of the spinnerets may include a central axis, with the respective central axis of each spinneret being generally radially spaced apart relative to one another. The spacing between adjacent shafts is preferably at least the radius of annular body, preferably in the range from the radius to 10 times the radius of the annular body.

For example, where the spinneret comprises discs or rings, two or more rings may be used with central axis radially spaced apart over the liquid reservoir. In some forms, a plurality of discs or rings may also be axially spaced apart along each central axis, providing an electrostatic spinning apparatus having a plurality of axially and radially spaced apart discs or rings. The discs/rings can be spaced apart along the central axis and each central axis is spaced apart either in parallel or at various angles relative to each other. In some forms, adjacent discs along a first central axis may be staggered with respect to adjacent disc on an adjacent central axis.

Where the spinneret comprises a tubular shaped coil, two or more coils may be used with central axis radially spaced apart over the liquid reservoir. The loops of these coils may be orientated to fit within the respective coil spaces of the adjacent coil or coils. The number of the coil spinnerets used in the charged electrode can vary from 2 to 200. The distance between the adjacent coils is preferably from the coil radius to 10 times of the coil radius. Each of the coils of the charged electrode can be arranged to rotate in the same direction or in differing directions relative to each other.

The viscous liquid can be loaded on the surface of the wire coils using a number of different arrangements. In some embodiments, the spinneret is movable, allowing portions of the spinneret to contact the liquid reservoir and move that portion into the electric field between the counter electrode and charged electrode for electrospinning. In other embodiments, the liquid reservoir is in liquid communication with the coils of the spinneret, enabling the viscous liquid to be continuously feed to and/or between the loops of the coil.

In one embodiment where the spinneret preferably has a tubular helical coil, disc or ring configuration, the reservoir comprises a liquid bath in which a portion of the spinneret is immersed. Here, the spinneret is positioned above the liquid bath and is configured to rotate about its center axis in order to coat a portion of the viscous liquid on a surface of the spinneret and move that coated surface out from the liquid reservoir into the electrospinning zone. The counter electrode is preferably orientated substantially parallel to the central axis of the spinneret and preferably extends substantially along the length of the spinneret. The coated portion of the spinneret rotates out from the bath and into the electric field in the electrospinning zone.

The counter electrode in this embodiment preferably includes a rotating tubular body on which the nano-fibres produced are continuously collected during the electrospinning process. Additionally or alternatively, the apparatus can further include a conveyer belt.

In other embodiments where the spinneret preferably has a conical coil configuration, the reservoir can be formed within a liquid enclosure bounded by the loops of the coils of the spinneret. Adjacent loops of the coil are preferably spaced apart by a distance that enables surface forces of the viscous liquid to retain that liquid between the loops and within the reservoir when the potential difference between the counter electrode and spinneret is below a critical value. Liquid will generally be drawn between the loops when the potential difference (and the corresponding electric field) reaches the critical intensity due to the formation of liquid jets.

The counter electrode in this embodiment is preferably substantially perpendicularly orientated to the central axis of the spinneret. Preferably, the counter electrode is located underneath the spinneret. The viscous liquid can thus be electrospun in a downwardly direction from the reservoir in the spinneret to a counter electrode located below the spinneret. In order to collect the formed nanofibres, this counter electrode preferably circumscribes an area equal to at least the width of the spinneret at that location, and more preferably more than four times the width of the spinneret. Suitable configurations for the counter electrode include a plate located underneath the spinneret.

The electrostatic spinning apparatus according to the present invention may also include a fluid source with an outlet located in the electrospinning zone, and preferably proximate the spinneret. A fluid source in the electrospinning zone directed on formed fibres can be used to adjust fibre properties, such as fibre diameter and to provide a larger percentage of isolated fibres in the fibres produced from the spinneret. The fluid source can have a fluid flow generally directed to flow from the spinneret to the counter electrode. The fluid source is preferably a gas, such as air, nitrogen or similar. The fluid can be in a temperature different to the ambient operating environment. In some embodiments a supply of drying air can be provided between the spinneret and the counter electrode.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

Example 1

Tubular Coil Spinneret

Experimental Set Up

Figure 1:
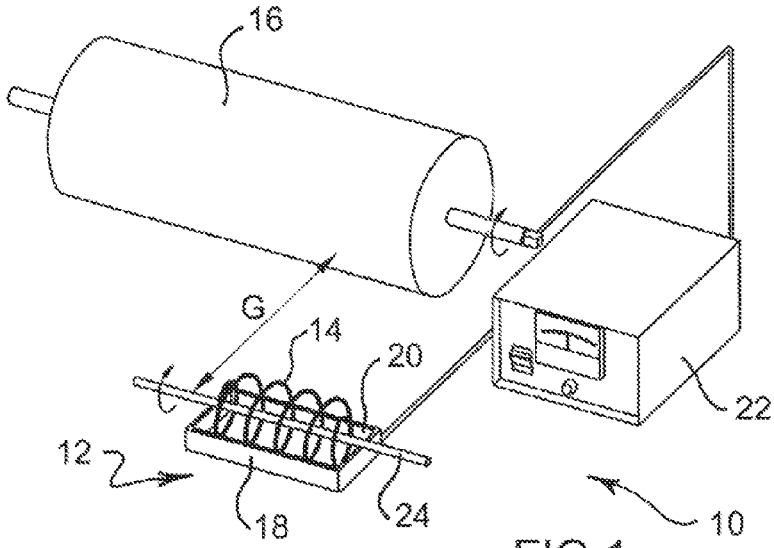
FIG. 1 is a schematic view of the set up for a tubular coil electrospinning apparatus according to one preferred embodiment of the present invention.

Referring firstly to FIG. 1, there is shown an electrospinning apparatus 10 according to a first embodiment of the present invention. This electrospinning apparatus 10 includes a charged electrode 12 which includes a rotatable tubular helical coil spinneret 14, a rotatable tubular counter electrode 16, a bath 18 containing a polymer solution 20 and a high voltage power supply power supply 22 (in this case a ES100P model power supply from Gamma High Voltage Research) connected between the charged electrode 12 and counter electrode 16. The counter electrode 16 comprises a metallic drum positioned above and lengthwise parallel with the spinneret 14. While not shown, the rotation of each of the spinneret 14 and the counter electrode 16 is driven by a drive means such as an electric motor which rotates each of the spinneret 14 and the counter electrode 16 at 40 rpm.

Figure 2:
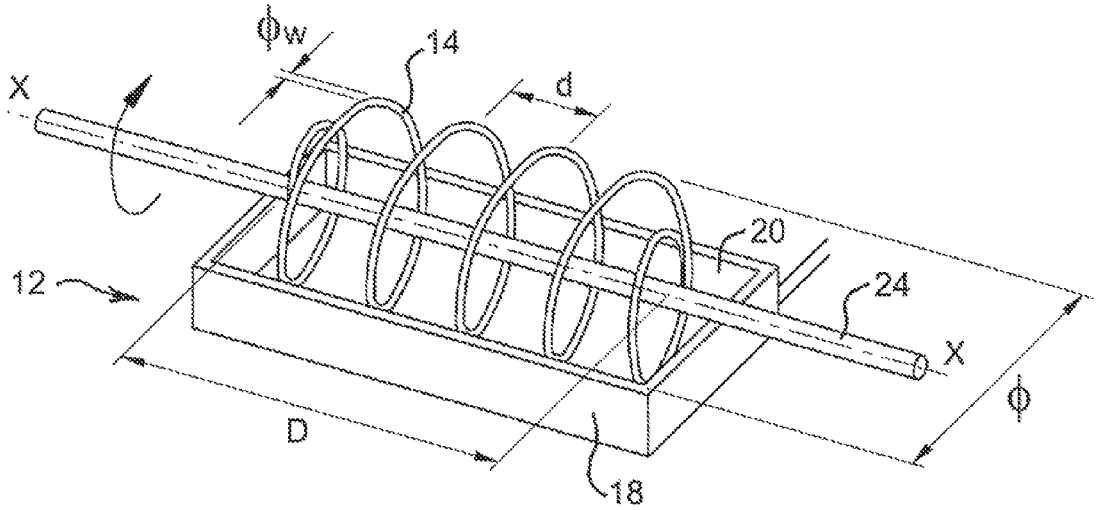
FIG. 2 provides a more detailed view of the tubular coil spinneret used in the apparatus shown in FIG. 1.

A more detailed view of charged electrode 12 is shown in FIG. 2. The illustrated spinneret 14 is a tubular shaped spiral coil made from a metal wire coil. The spinneret 14 includes five annular loops of wire radially centred about and extending along a central axis X-X. The end wire portions of the coil are connected to a metal tubular axle 24. The spinneret 14 rotates about the axle 24. The spinneret 14 is positioned between the bath 18 and the counter electrode 16 with a bottom section partially immersed in the polymer solution 20 in the bath 18. Slow rotation of the spinneret 14 within the bath 18 coats a thin layer of polymer solution onto the surface of the wires of the spinneret 14. These coated sections rotate about the axle 24 to a position between the bath 18 and the counter electrode 16.

For experimental purposes, an aqueous polymer solution 20 comprising PVA (polyvinyl alcohol, average molecular weight 146,000-186,000, 96% hydrolysed) obtained from Aldrich-Sigma was used to form nano-fibres. It should be appreciated that other polymer solutions could also be used for nanofibre formation using the illustrated apparatus. The polymer solution 20 in the bath 18 is electrically connected to the power supply 22 via an immersed electrode (not shown). The counter electrode 16 is connected to the ground electrode of the power supply 22 and is used to collect nanofibres formed using the apparatus 10.

For comparison purposes, a conventional needle electrospinning setup (not shown) having a needle gauge, outer diameter of 0.82 mm and inner diameter of 0.51 mm was used to electrospin nanofibres using the same PVA polymer solution as used for the coil apparatus 10. Electrospinning was conducted at an applied voltage of 22 kV and a collecting distance of 15 cm.

The average fibre diameter of the nanofibres produced in experimental runs was calculated from SEM photos of the nanofibres with the aid of image analysis software ImagePro+ 4.5.

Experimental Results

During electrospinning, viscous PVA solution was loaded on the wire surface of the coil spinneret 14 by slow rotation of the spinneret 14. A high voltage was then applied between the polymer solution and the collector drum to form a plurality of polymer jets on the top part of the spiral coils of the spinneret 14. These polymer jets were produced from points on the top part of the coils of the spinneret 14 and had about a 90° spread relative to a perpendicular central angle from the formation point on the coil surface. The minimum applied voltage that induced polymer jet formation was about 40 kV. The nanofibres produced by the apparatus 10 were much thinner had a narrowed diameter distribution as compared to those produced by the conventional needle electrospinning apparatus.

Nanofibre productivity for the spiral coil electrospinning was found to be as high as 16 g/hr. In comparison, nanofibre productivity of the needle electrospinning system was less than 0.3 g/hr.

Figure 3:
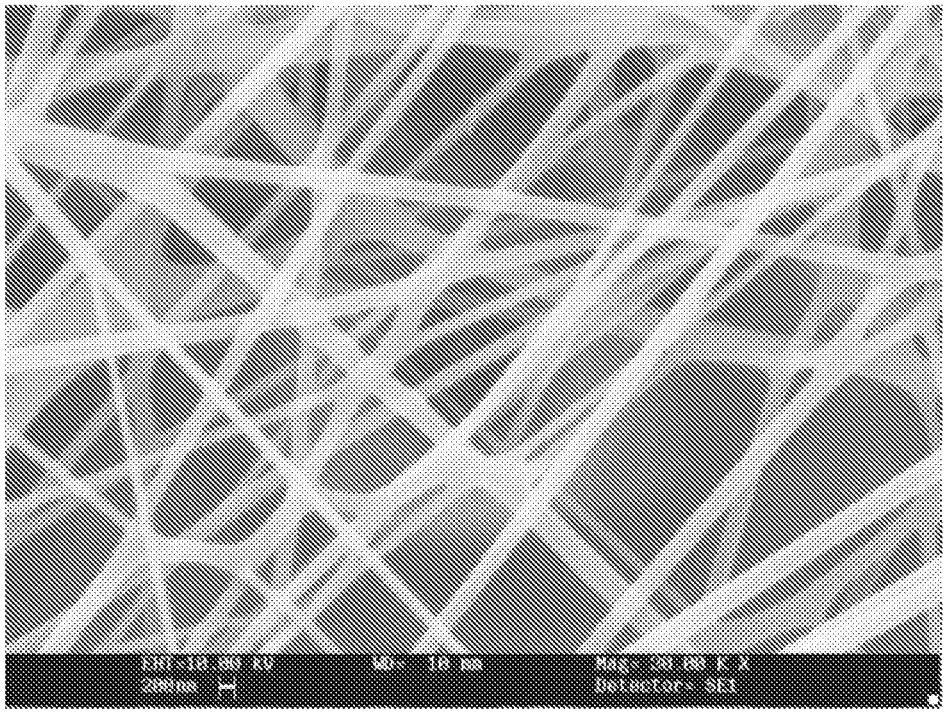
FIG. 3 is an SEM image of nanofibres produced using the apparatus shown in FIG. 1 at a collecting distance of 13 cm.
Figure 4:
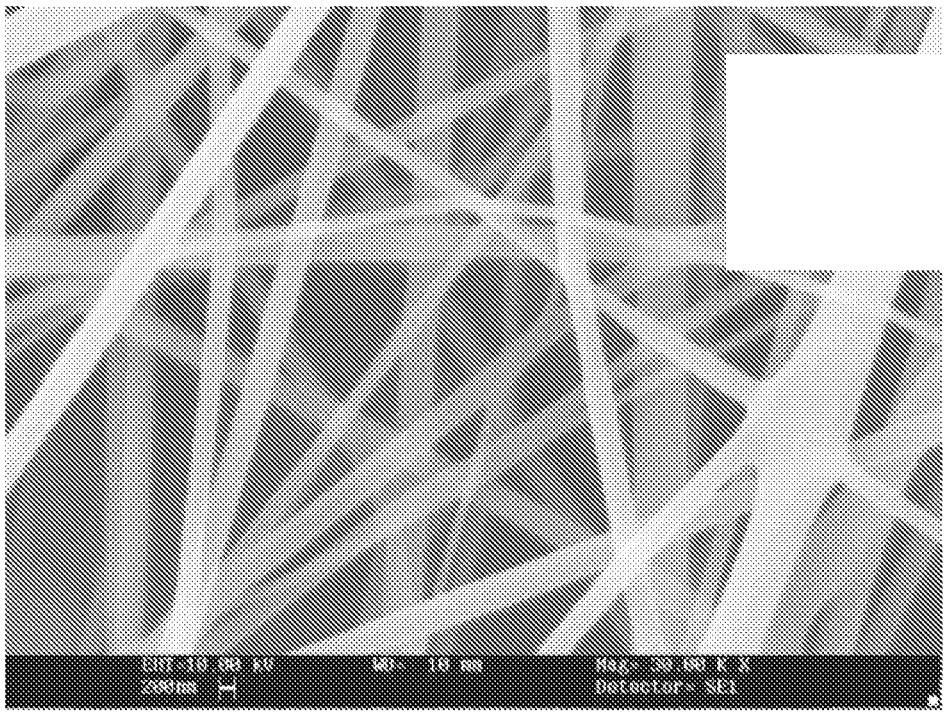
FIG. 4 is an SEM image of nanofibres produced using the apparatus shown in FIG. 1 at a collecting distance of 18 cm.
Figure 5B:
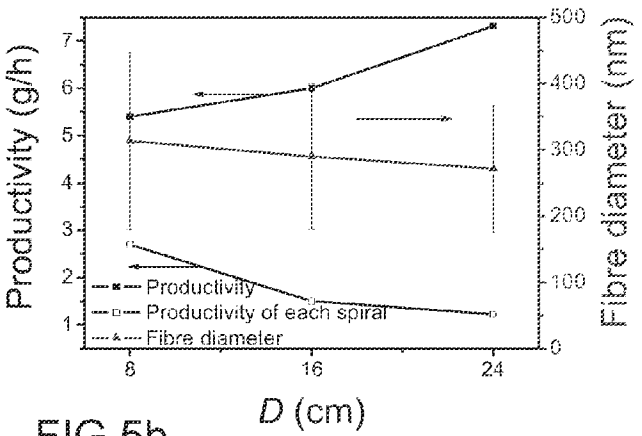
FIG. 5 provide graphical results of experimental runs using the apparatus shown in FIG. 1 illustrating the effects of operating parameters and coil dimensions on the fibre diameter and productivity, namely (a) coil distance d, (b) spinneret length D; (c) coil diameter $\phi$; (d) applied voltage; (e) wire diameter $\phi w$; (f) collecting distance G.
Figure 5D:
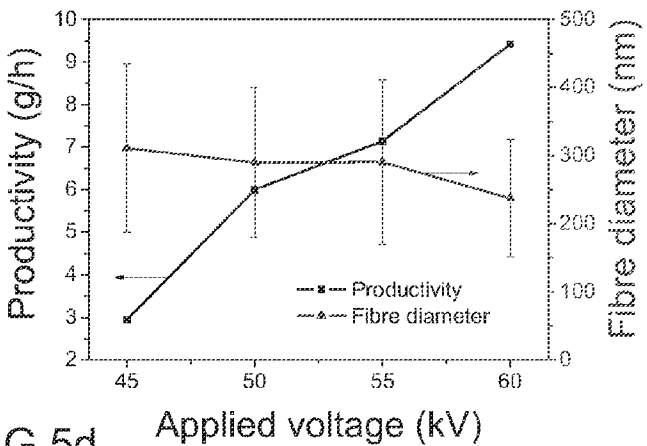
Figure 5A:
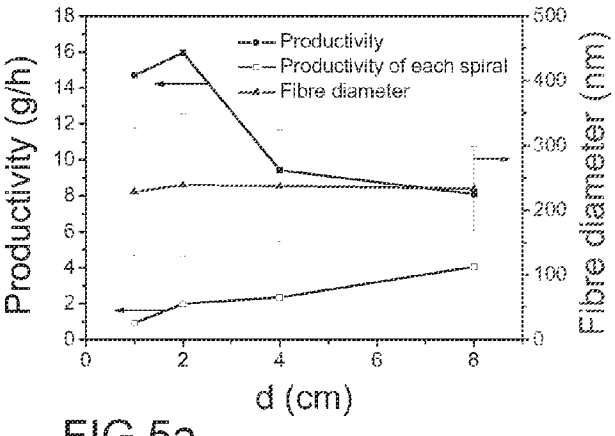
Figure 5C:
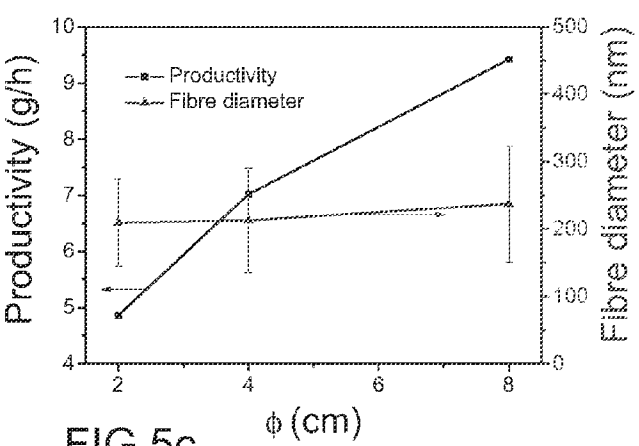
Figure 5F:
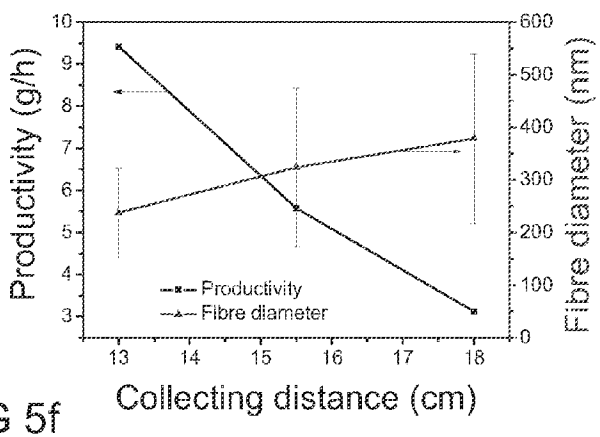
Figure 5E:
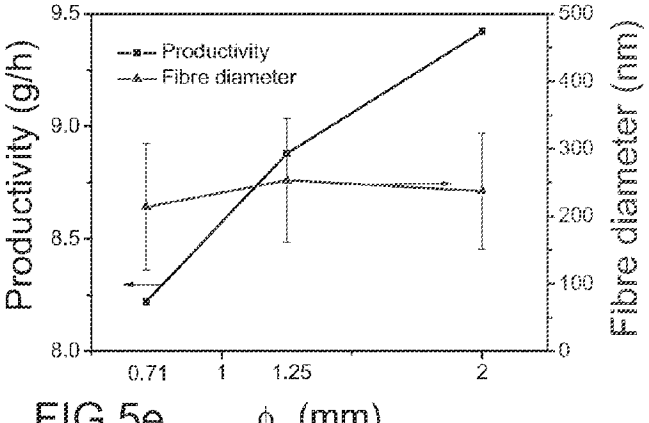

FIGS. 2 and 3 shows the morphologies of as-spun nanofibres under a scanning electron microscope (SEM, Leica S440) collected at collecting distances G of 13 cm and 18 cm. As shown, the majority of the fibres have nano scale thicknesses and are collected in the form a non-woven structure. The 13 cm collecting distance (FIG. 2) resulted in finer nanofibres, but a more interconnected fibrous structure than the nanofibres collected over the 18 cm collecting distance G (FIG. 3). The differences in morphology were considered a result of the shorter solvent evaporation time provided by the shorter collecting distance of 13 cm as compared to 18 cm.

FIGS. 5(*a*) and 5(*b*) show that changes in the coil dimensions influence fibre productivity. Increasing the coil length D (and number of coils in that length) increased overall nanofibre productivity of the apparatus 10 but decreased the nanofibre productivity per coil (PPC) of the spinneret 14. Increasing the coil distance (d) within the range of 1 cm to 2 cm increased the productivity of nanofibre formation. However, productivity decreased when the distance was larger than 2 cm. Increasing the coil distance d increased the PPC, suggesting increased electrospinning efficiency.

As shown in FIGS. 5(*c*) and 5(*e*), overall nanofibre productivity increased with a larger coil diameter $\phi$. This is likely a result of a larger coated surface area providing more locations for the formation of polymer jets. Using a larger wire diameter $\phi w$ (FIG. 5(*e*)) also increased nanofibre productivity.

FIGS. 5(*d*) and 5(*f*) show the expected productivity increases when using a greater applied voltage. A greater applied voltage also produced finer fibres with a narrower diameter distribution. When the applied voltage was 60 kV, the average fibre diameter was 237 nm. As expected, nanofibre productivity decreased when using greater collecting distances G. It was also found that a higher PVA concentration increased fibre diameter and reduced nanofibre productivity.

Figure 6:
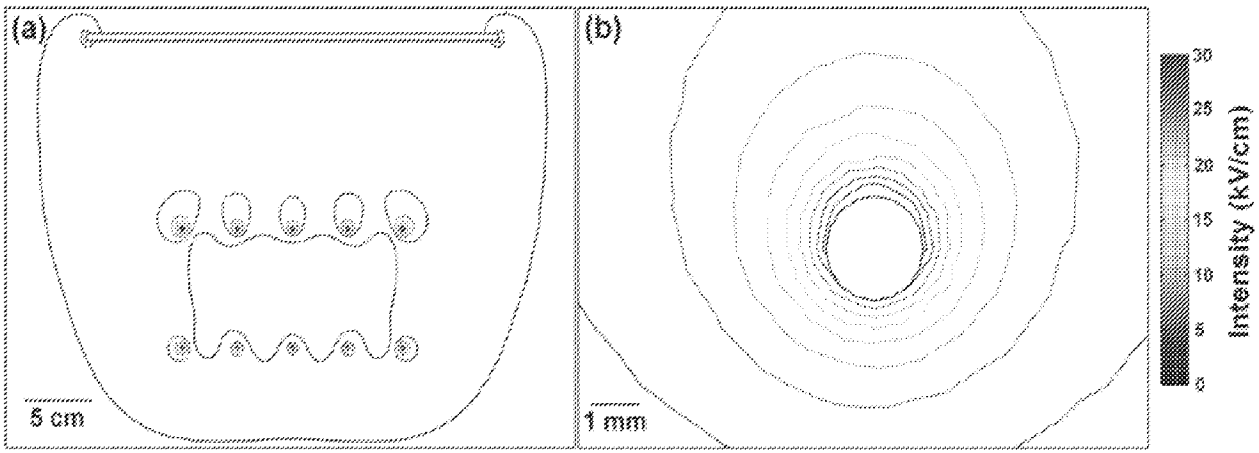
FIG. 6 provides a cross-sectional view of calculated electric field intensity profiles for the tubular coil spinneret shown in FIG. 2 at an applied voltage of 60 kV showing (a) full coil view; and (b) magnified view of a single loop of the coil.

FIGS. 6*a* and 6*b* illustrates the electric field intensities of the spiral coil spinneret 14 calculated using finite element analysis (using FEMLAB3.4). The analysis shows that the field lines for the tubular coil spinneret 14 were concentrated around the wire surface due to the small radius of curvature of the wire loops of the coil of the spinneret 14. The electric field is the main driving force to initiate the polymer jets during electrospinning. In this respect, a polymer solution charged by a stronger electric field generates jets more easily, is stretched more and thereby results in higher nanofibre productivity.

Figure 7:
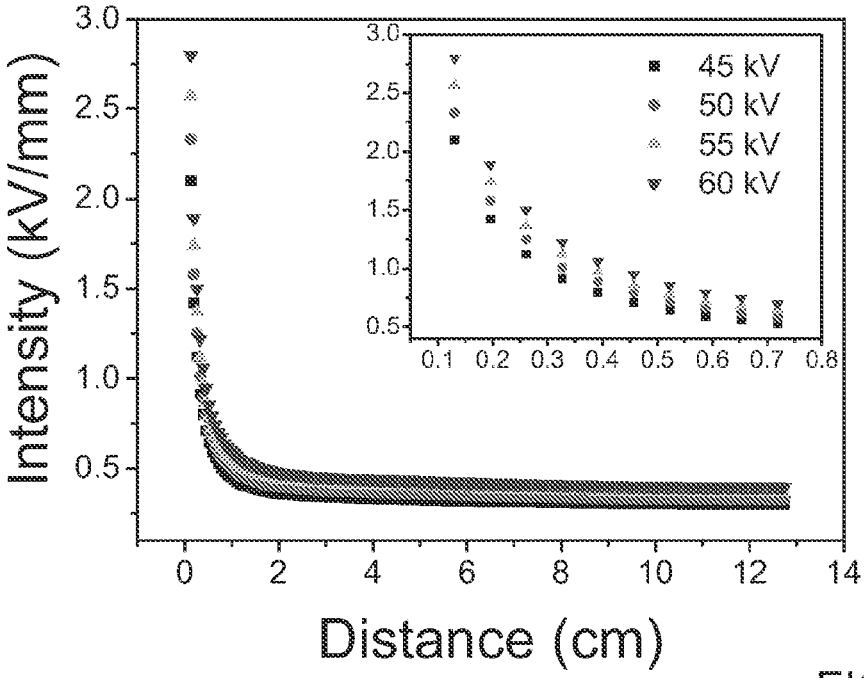
FIG. 7 provides a plot of the electric field intensity for the tubular coil spinneret along the electrospinning direction.
Figure 8:
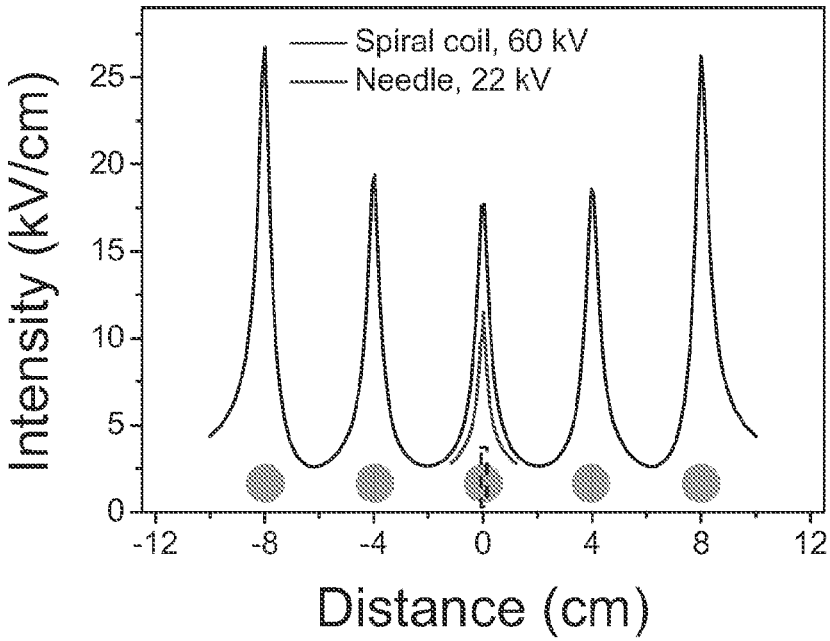
FIG. 8 provides an electric intensity profile of coil electrospinning along the central axis of the coil.

The effects of coil dimensions on the electric intensity profile are shown in FIGS. 7 and 8. As shown in FIG. 7, the electric field intensity decayed rapidly from the coil surface of the spinneret 14 to the counter electrode 16. FIG. 8 shows that the electric field intensity at the outer coils (or ends of the spinneret) is greater than at those coils away from the ends. This difference in intensity could be addressed by reducing the coil diameter of at least a portion of the outer coils.

Conclusion

A large number of nanofibre forming jets can be generated simultaneously on the top part of a tubular spiral coil spinneret 14. The nanofibres produced using this apparatus 10 have a finer average fibre diameter than these produced by a conventional needle electrospinning system. Productivity and fibre morphology can be optimised by adjusting the coil shape and operating parameters of the apparatus 10.

Example 2

Conical Coil Spinneret

Experimental Set Up

Figure 9:
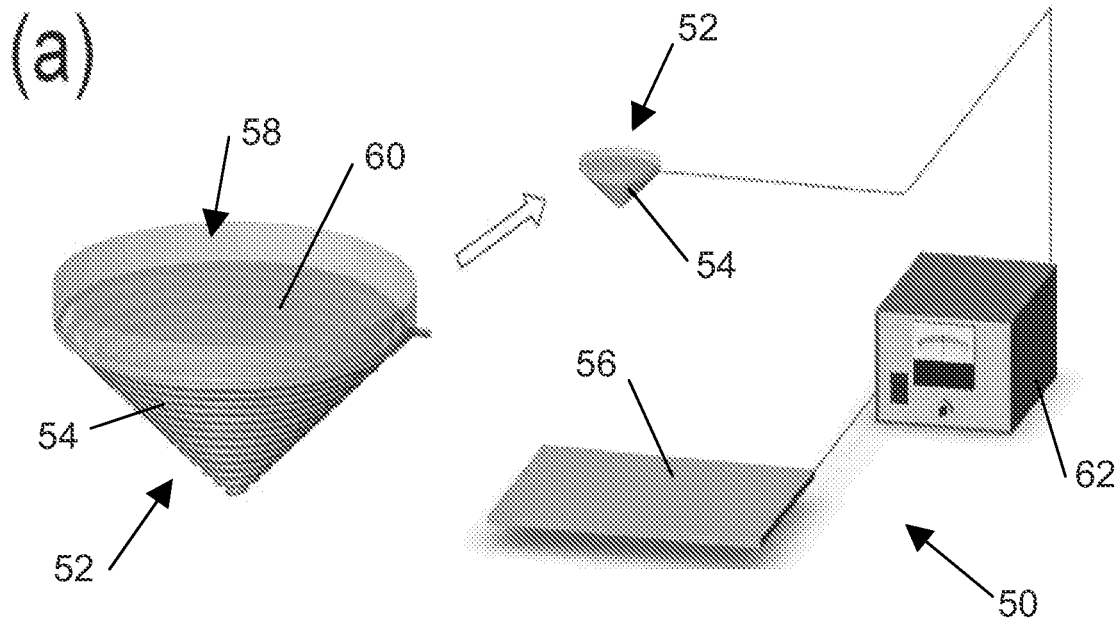
FIG. 9 is a schematic view of the set up for a conical coil electrospinning apparatus according to one preferred embodiment of the present invention.

Referring to FIG. 9, there is shown an electrospinning apparatus 50 according to a second embodiment of the present invention. This electrospinning apparatus 50 includes a charged electrode 52 which includes a conical wire-coil spinneret 54, a counter electrode 56, and a high voltage power supply power supply 62 (in this case a ES100P model power supply from Gamma High Voltage Research) connected between the charged electrode 52 and counter electrode 56. The counter electrode 56 comprises a metal mesh plate positioned below the spinneret 54.

The illustrated spinneret 54 comprises a cone-shaped wire coil made from copper wire having a wire diameter of 1 mm. The spinneret 54 is 15 mm in height and has a cone angle of about 120°. The wire of the spinneret 54 is connected to a high voltage power supply.

Figure 10:
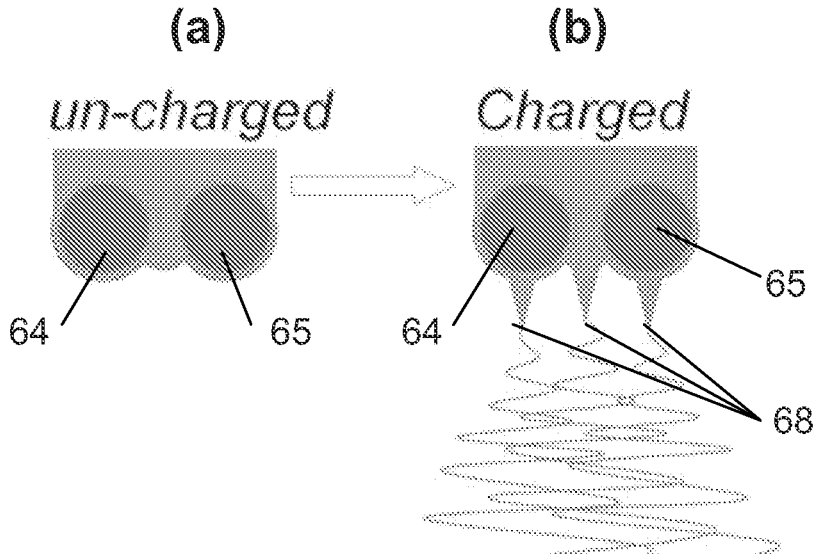
FIG. 10 is an illustration of jet formation on the coil surface of two loops of the conical coil spinneret shown in FIG. 9.

The spinneret 54 is a closed cone extending from an open top surface to a base point to define a liquid reservoir 58 inside the cone in which a polymer solution 60 can be held. As shown in FIG. 10, the spacing between the loops 64, 65 of the coils of the spinneret 54 is about 1 mm to enable surface forces and the viscoelastic nature of the polymer solution to substantially retain the polymer solution between the loops 64, 65 and the reservoir 58 when the potential difference between the counter electrode 56 and spinneret 54 is below a critical value (as shown in FIG. 10(*a*)). As shown in FIG. 10(*b*), the polymer solution forms liquid jets (in the form of Taylor cones) on the surface of the loops 64, 65 and on the liquid surface between the loops 64, 65 when the potential difference in the electrospinning zone between the counter electrode 56 and spinneret 54 reaches the critical value.

For experimental purposes, PVA (average molecular weight 146,000 to 186,000, 96% hydrolysed) obtained from Aldrich-Sigma was used to as the polymer solution to form nano-fibres. It should be appreciated that other polymer solutions could also be used for nanofibre formation using the illustrated apparatus. The polymer solution 60 in the bath 58 is electrically connected to the power supply 62 via the spinneret 52. The counter electrode 56 is connected to the ground electrode of the power supply 62 and is used to collect nanofibres formed using the apparatus 60.

For comparison purposes, a conventional needle electrospinning apparatus (not shown) having a needle gauge, outer diameter of 0.82 mm and inner diameter of 0.51 mm was used to electrospin nanofibres using the same PVA polymer solution, with applied voltage and collecting distance 22 kV and 15 cm, respectively.

The average fibre diameter of the nanofibres produced in experimental runs was calculated from SEM photos of the nanofibres with the aid of image analysis software ImagePro+ 4.5.

Experimental Results

For electrospinning, the wire cone spinneret 54 was filled with a viscous PVA solution. A high electric voltage was then applied between the wire coil spinneret 14 and counter electrode 56 using the power supply 62. This caused the charged polymer solution to move between the wire loops 64, 65 of the coils of the spinneret 14 and cover the outer surface of these loops 64, 65 as shown in FIG. 10(*b*). A number of jets 68 were then generated, mainly on the conical wire surface of the loops 64, 65. These jets 68 were generated from those areas on the wire surface that had sufficient polymer solution on the surface. Jet 68 stopped forming once the solution was temporarily exhausted from that area, and started in a second adjoining area with sufficient polymer solution on the surface. This allowed the first area to be replenished with polymer solution, and reform a jet 68 once another adjoining surface was exhausted of polymer solution. The minimum voltage to generate jets 68 was found to be 45 kV, and the lowest voltage that led to the occurrence of corona discharge was 70 kV. Nanofibres could be electrospun using the apparatus 50 without any difficulty between 45 kV and 70 kV.

Figure 11:
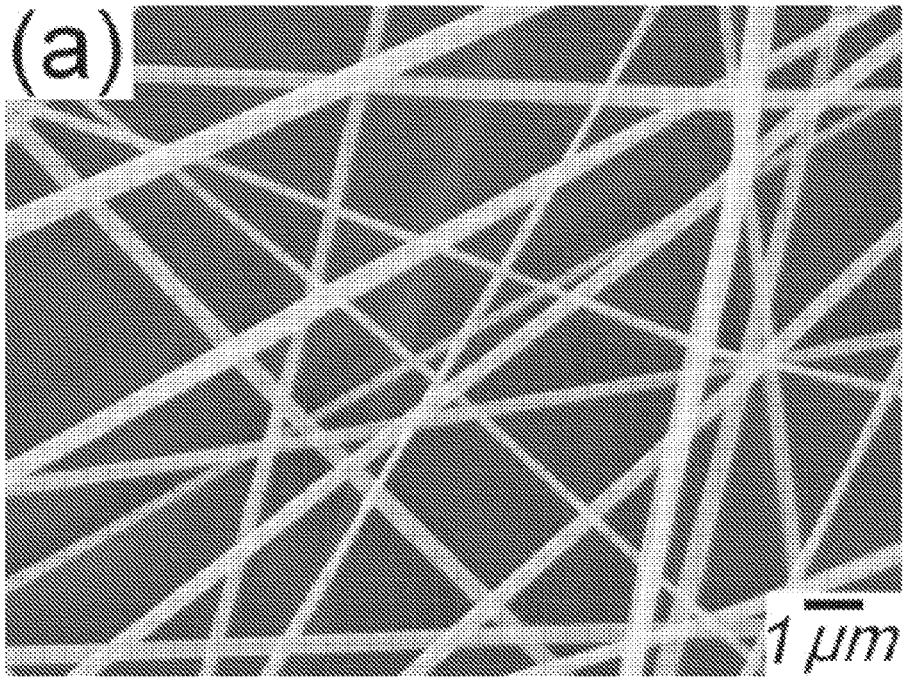
FIG. 11 is an SEM image of typical nanofibres electrospun from the conical wire coil electrospinning apparatus shown in FIG. 9 at a potential difference of 60 kV, PVA concentration of 9 wt % and collecting distance of 15 cm.
Figure 12:
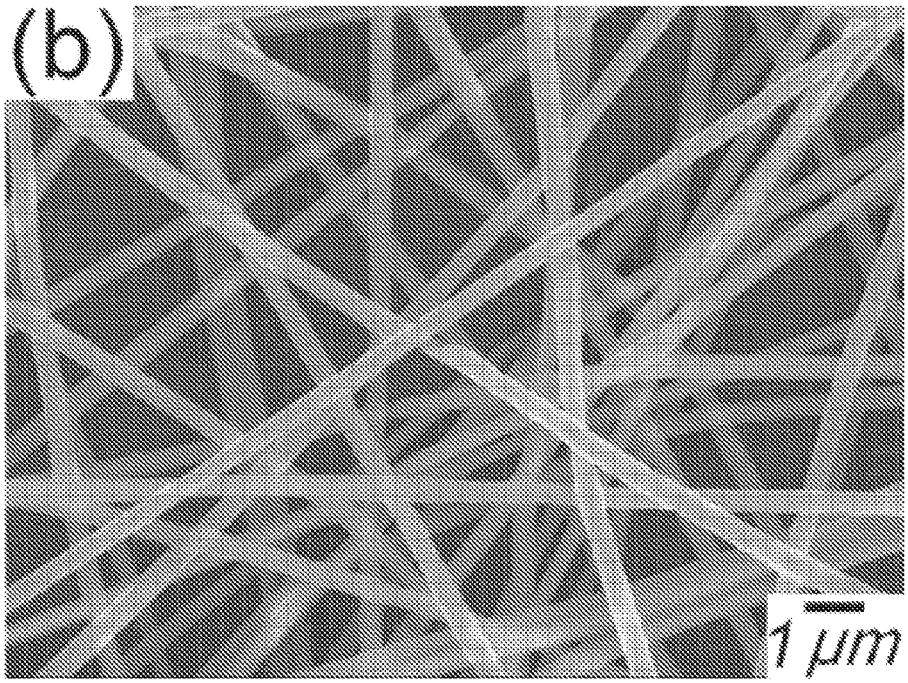
FIG. 12 is an SEM image of typical nanofibres electrospun using a conventional needle electrospinning using a potential difference of 22 kV, a PVA concentration of 9 wt % and a collecting distance of 15 cm.

The typical nanofibre morphology of a nanofibre spun using the conical coil spinneret 54 is shown in the SEM image of FIG. 11. The nanofibres electrospun from 9 wt % PVA solution at different applied voltages all showed bead-free fibrous morphology. For comparison purposes, the fibre morphology of nanofibres produced using a needle based electrospinning device is shown in FIG. 12. The as-spun fibres produced using the needle based electrospinning device also show good fibre uniformity.

Figure 13A:
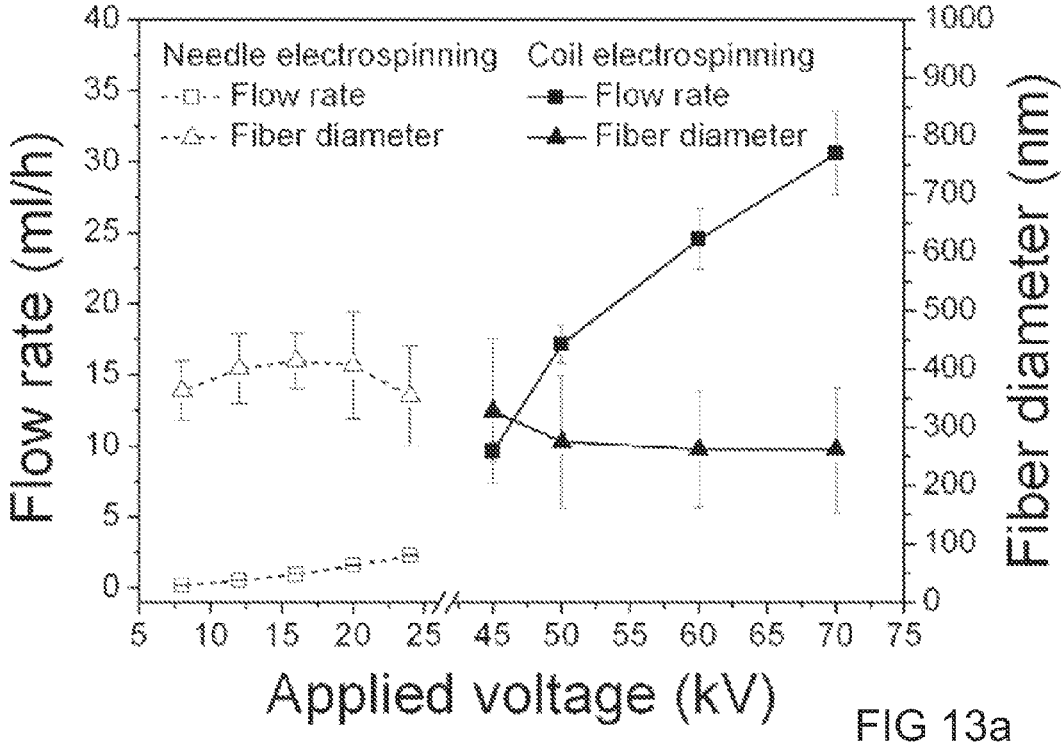
FIG. 13 provide graphical results of experimental runs using the apparatus shown in FIG. 9 illustrating the effects of operating parameters and coil dimensions on the fibre diameter and productivity, namely (a) dependence of volume rate and average fibre diameter on applied voltages; and (b) diameter of nanofibres from traditional needle and conical coil electrospinning with different PVA concentrations.
Figure 13B:
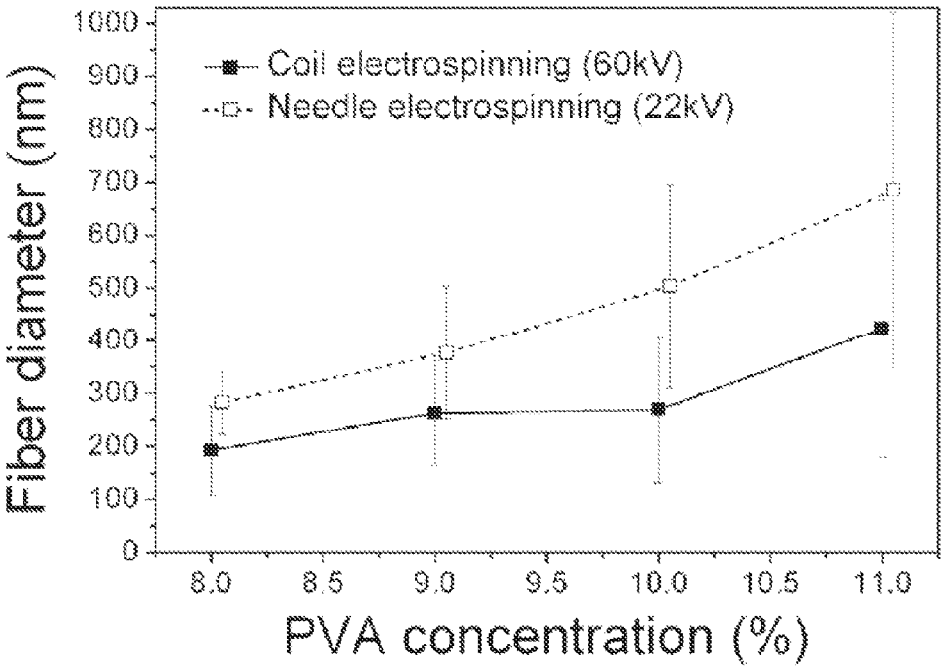

FIG. 13(*a*) provides an indication of the dependence of volume rate and average fibre diameter on applied voltages for the conical coil electrospinning apparatus 50 and a conventional needle electrospinning apparatus. The figure shows that variation in applied voltage led to changes in the fibre fineness in both the coil 50 and needle apparatus. For the wire coil apparatus 50, increasing the applied voltage from 45 kV to 50 kV reduced the average fibre diameter from 327±123 nm to 275±113 nm. Further increases in the voltage resulted in minute changes in the fibre diameter and distribution. In comparison, for the needle apparatus, increasing the applied voltage from 8 to 16 kV increased the average fibre diameter. The variation of fibre diameter in the applied voltage range (8~24 kV) was between 353.4±85 nm and 413±48 nm. Overall, the average fibre diameter for the wire coil apparatus 50 electrospun nanofibres were smaller than the nanofibres produced from needle electrospinning.

The fibre productivity for this electrospinning system can be estimated based on the volume rate. According to the volume rate data given in FIG. 13(*a*), the highest production rate for producing dry nanofibres using the conical coil electrospinning apparatus 50 was calculated to be 0.86 g/hr at 45 kV and 2.75 g/hr at 70 kV. In comparison, the highest rate of producing dry nanofibres from the needle electrospinning apparatus based on the volume rate value was 0.018 g/hr at 8 kV and 0.207 g/hr at 24 kV.

The average diameter of nanofibres electrospun from PVA solutions of different concentrations is shown in FIG. 13(*b*). Under the same applied voltage, with the increase in the PVA concentration, both the average fibre diameter and diameter distribution increased slightly. In comparison, the diameter data of the nanofibres electrospun by the needle electrospinning under the optimized conditions, which produced the finest nanofibres, is also shown in FIG. 13(*b*). With the same PVA concentration, the nanofibres from conical coil spinneret always had smaller average fibre diameter.

Figure 14:
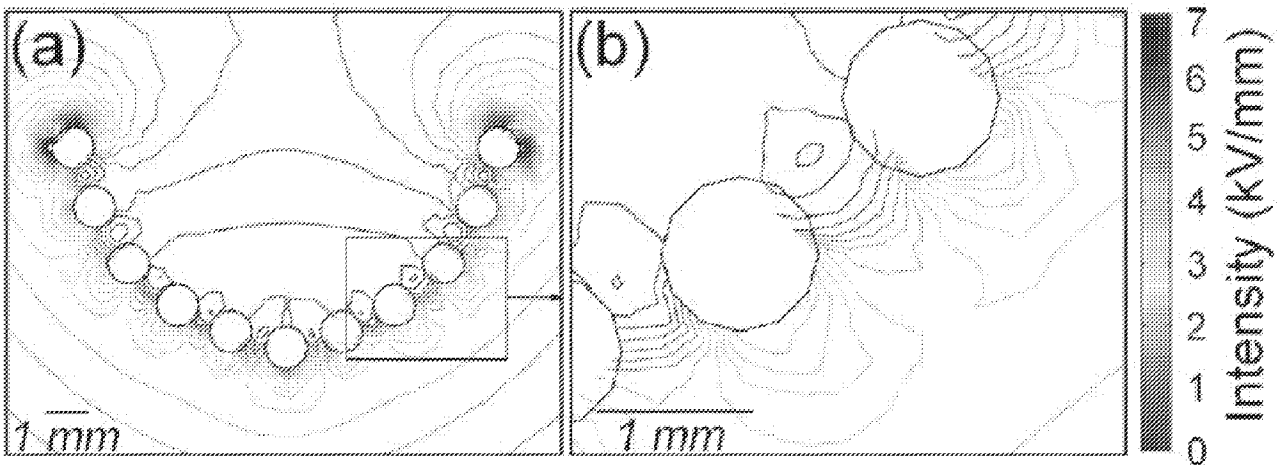
FIG. 14 provides a cross-sectional view of calculated electric field intensity profiles for the conical coil spinneret shown in FIG. 9 at an applied voltage of 60 kV, showing (a) full coil view; and (b) magnified view of selected loops of the coil.
Figure 15:
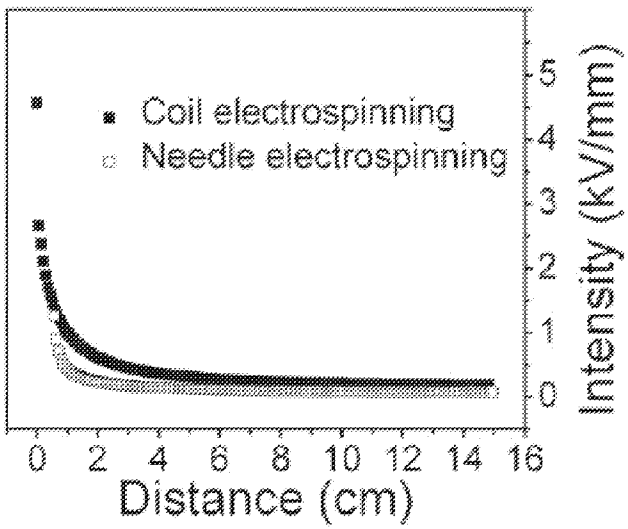
FIG. 15 provides a plot of the electric field intensity for the conical coil spinneret along the electrospinning direction.

FIG. 14 shows the electric field intensity profile of the conical coil spinneret 54 calculated using finite element analysis (using FEMLAB3.4). As shown, the conical wire coil spinneret 54 gives concentrated field lines around the wire surface due to the small radius of curvature of the wire of the loops. The concentrated field lines of lesser field intensity are also formed between the adjacent wires. It should be appreciated that the electric field is the main driving force for initiating the formation of a jet of polymer solution. A polymer solution charged by an electric field of a higher intensity is easier to generate jets, and these jets should be stretched under stronger forces, hence producing finer fibres.

Conclusion

Electrospinning of PVA nanofibres using a conical wire coil spinneret 54 produces a large number of liquid jets simultaneously on the conical coil surface, providing good fibre productivity. Furthermore, the resultant nanofibres had a finer average fibre diameter than that produced by a conventional needle electrospinning system.

Example 3

Disc Spinneret

Experimental Set Up

Figure 16:
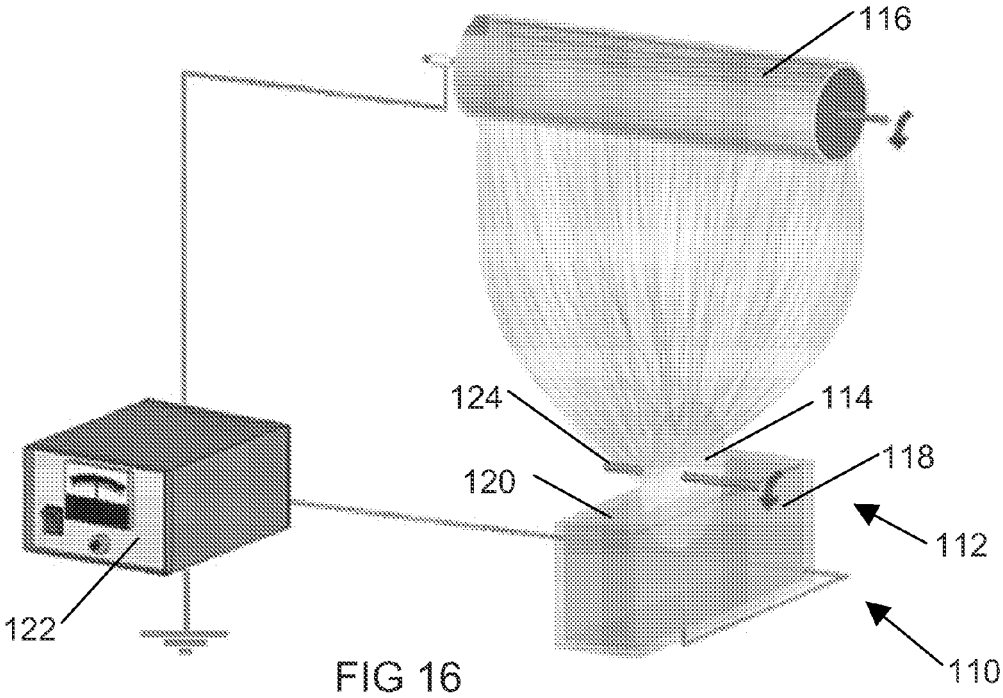
FIG. 16 is a schematic view of the set up for a disc electrospinning apparatus according to one preferred embodiment of the present invention.

Referring firstly to FIG. 16, there is shown an electrospinning apparatus 110 according to a third embodiment of the present invention. This electrospinning apparatus 110 includes a charged electrode 112 which includes a rotatable disc spinneret 114, a rotatable drum counter electrode 116, a bath 118 containing a polymer solution 120 and a high voltage power supply power supply 122 (in this case a ES100P model power supply from Gamma High Voltage Research) connected between the charged electrode 112 and counter electrode 116. The counter electrode 116 comprises a metallic drum positioned above and lengthwise parallel with the spinneret 114. While not shown, the rotation of each of the spinneret 114 and counter electrode 116 is driven by a drive means such as an electric motor which rotates each of the spinneret 114 and counter electrode 116 at 40 rpm.

The illustrated spinneret 114 is an aluminium disc 2 mm long and 8 cm in diameter. The spinneret 114 is positioned between the bath 118 and the counter electrode 116 with a bottom section partially immersed in the polymer solution 120 in the bath 118. Slow rotation of the spinneret 114 within the bath 118 coats a thin layer of polymer solution onto the surface of the wires of the spinneret 114. These coated sections rotate about the axle 124 to a position between the bath 118 and the counter electrode 116.

For experimental purposes, an aqueous polymer solution 120 comprising PVA (average molecular weight 146,000-186,000, 96% hydrolysed) obtained from Aldrich-Sigma was used to form nano-fibres. It should be appreciated that other polymer solutions could also be used for nanofibre formation using the illustrated apparatus. The polymer solution 120 in the bath 18 is electrically connected to the power supply 122 via an immersed electrode (not shown). The counter electrode 116 is connected to the ground electrode of the power supply 122 and is used to collect nanofibres formed using the apparatus 110.

For comparison purposes, an aluminium cylinder spinneret 20 cm long and 8 cm in diameter, was used in a similar experimental set up as used for the disc spinneret 114 shown in FIG. 16.

The average fibre diameter of the nanofibres produced in experimental runs was calculated from SEM photos of the nanofibres with the aid of image analysis software ImagePro+ 4.5.

Experimental Results

During electrospinning, viscous PVA solution was loaded on the surface of the disc spinneret 114 by slow rotation of the spinneret 114. A high voltage was then applied between the polymer solution and the collector drum to form a plurality of polymer jets on the top surface of the spinneret 114. The formation of jets/filaments was mainly influenced by the applied voltage and the polymer concentration.

For the disc spinneret 114, no liquid jet was formed when the applied voltage was lower than 42 kV. When the applied voltage was higher than this critical voltage, the jets were generated mainly on the sides of the disc edge. Increasing the applied voltage showed little influence on the electrospinning process. In comparison, electrospinning using the cylinder spinneret showed higher dependence on the applied voltage. The critical applied voltage for generating jets from the cylinder spinneret was about 47 kV. Despite the high applied voltage, the jets were just generated from two end areas of the cylinder. There was no jet/filament produced from the middle cylinder surface until the applied voltage reached 57 kV. Higher applied voltage led to the generation of jets from the entire cylinder surface. It is thought that the axial length of the cylinder spinneret had a greater effect on the electric field as compared to the narrow width of the disc spinneret 114.

Figure 17:
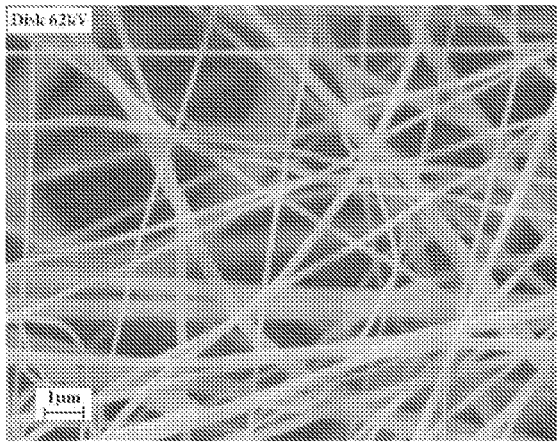
FIG. 17 is an SEM image of PVA nanofibres electrospun using the apparatus shown in FIG. 16 at an applied voltage of 62 kV, PVA concentration of 9.0 wt % and spinning distance of 13 cm.
Figure 18:
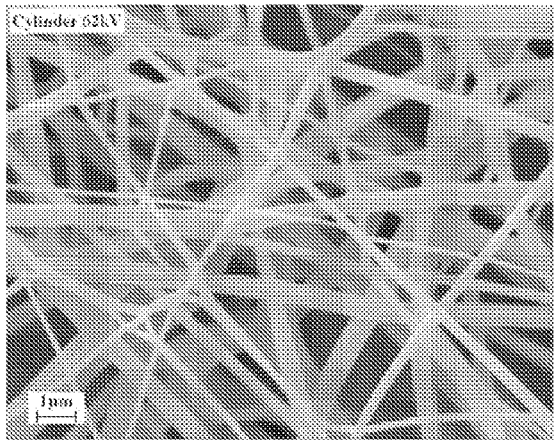
FIG. 18 is an SEM image of PVA nanofibres electrospun using a conventional cylinder type spinneret at an applied voltage of 62 kV, PVA concentration of 9.0 wt % and spinning distance of 13 cm.

As shown in the SEM images in FIGS. 17 and 18, the fibre morphology was also influenced by the applied voltage. The dependency of the average fibre diameters calculated from SEM images is provided in FIG. 19(*a*). As shown, nanofibres electrospun from the disc spinneret 114 showed bead-free fibrous structure.

Figure 19A:
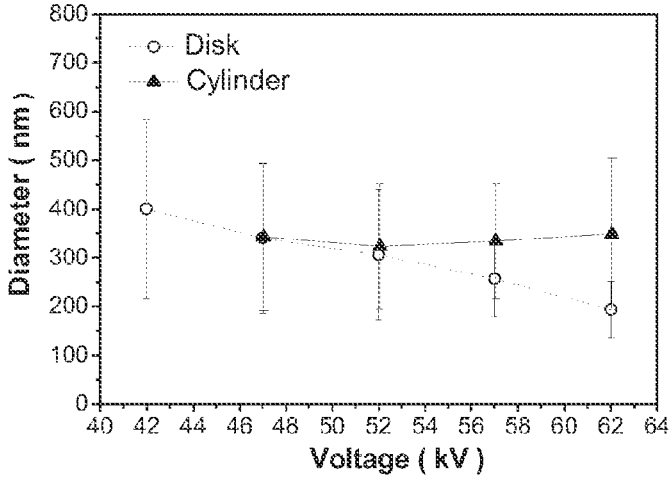
FIG. 19 provide graphical results of experimental runs using the apparatus shown in FIG. 16 and a cylinder spinneret having the same diameter but 100 times longer, the effects of operating parameters and coil dimensions on the fibre diameter and productivity, namely (a) dependency of average fibre diameters on the applied voltage (PVA=9 wt %) (b) the dependence of average fibre diameter on PVA concentration (Collecting distance=11 cm, applied voltage=57 kV); and (c) productivity of nanofibres under different applied voltages (PVA=9 wt %) and PVA concentrations (Applied voltage=57 kV).
Figure 19B:
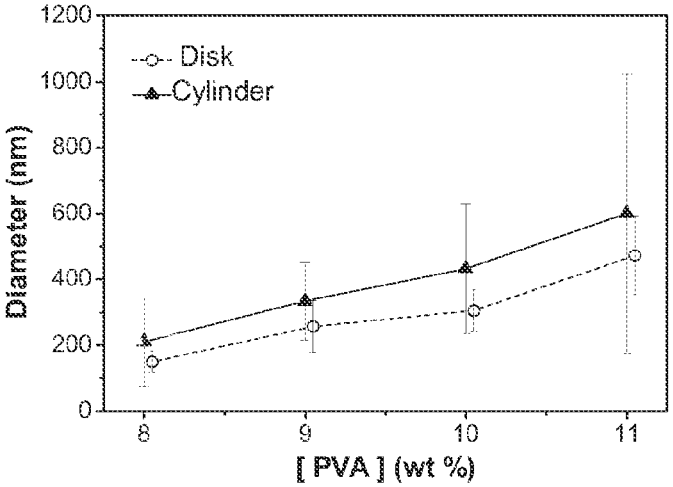
Figure 19C:
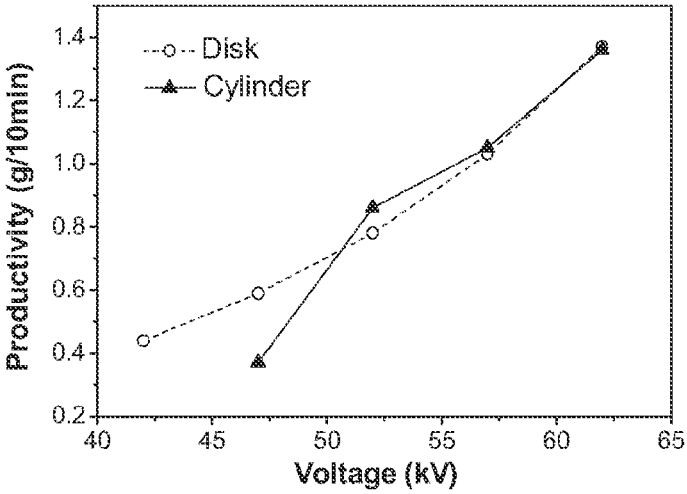

FIG. 19(*a*) shows that an increase in the applied voltage from 47 kV to 62 kV, reduces the average fibre diameter slightly and the diameter distribution became narrower. For the cylinder spinneret, the average fibre diameter and diameter distribution showed a very small dependence on the applied voltage. The variation of the applied voltage between 47 kV and 62 kV led to little change in fibre diameter and distribution.

Besides the applied voltage, the distance between the spinneret and collector also influenced the electrospinning process and fibre morphology. It was noticed that the distance between the spinneret 114 and collector for the disc electrospinning system could be adjusted between 11 cm and 19 cm. A shorter spinning distance led to wet fibres which merged to form a polymer film on the collector, while a longer spinning distance resulted in stoppage of electrospinning because of weak eclectic filed. For the cylinder electrospinning system, the range of electrospinning distance was narrower, ranging from 11 cm to 15 cm.

FIG. 19(*b*) shows that the polymer concentration was an important factor affecting the electrospinning process and fibre morphology. With the applied voltage at 57 kV, the nanofibres electrospun from both systems showed increased diameter when a high concentration of PVA solution was used. The as-spun fibres electrospun by the disc spinneret had finer fibres with much narrower diameter distribution than those from the cylinder spinneret. The nanofiber electrospun from disc spinneret 114 showed a lower dependence on the PVA concentration that the nanofiber electrospun from cylinder spinneret.

FIG. 19(*c*) shows that the productivity of a cylinder electrospinning unit was influenced by the applied voltage and polymer concentration. The production rate increased for both electrospinning systems with an increase in the applied voltage.

Figure 20:
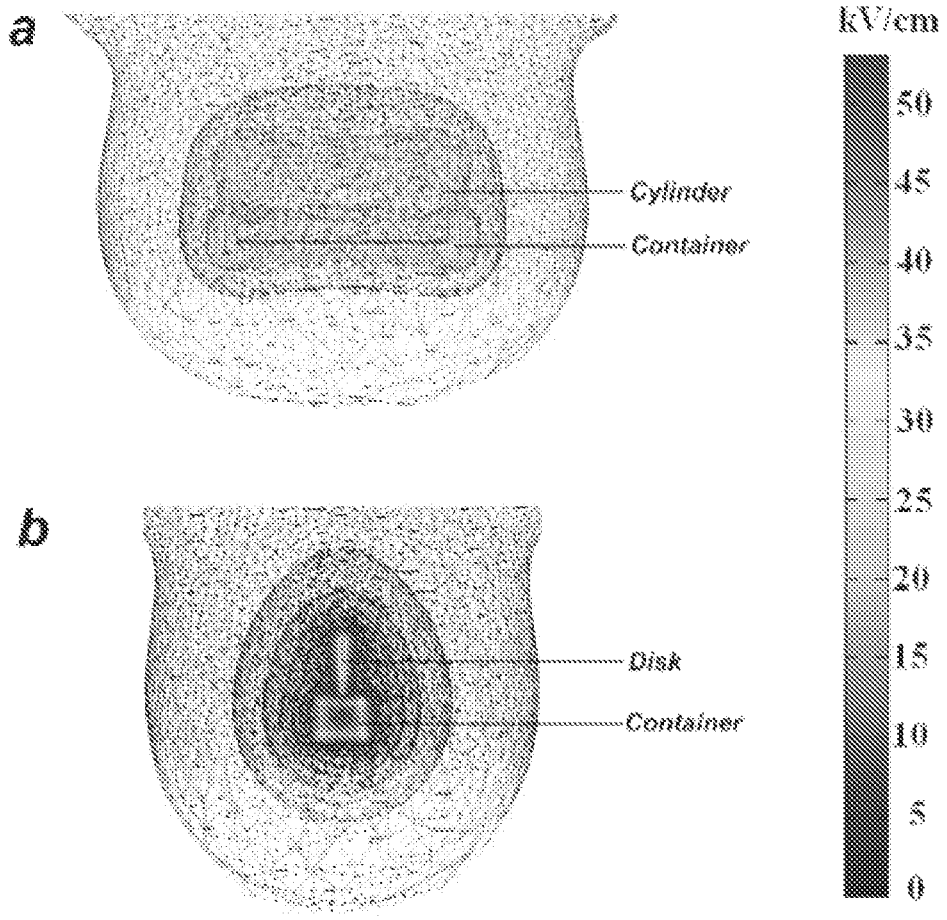
FIG. 20 provides a cross-sectional view of calculated electric field intensity profiles for the (a) cylinder and (b) disc spinnerets used in the apparatus shown in FIG. 16.

FIG. 20 shows the electric field profiles around the spinneret surface and in the electrospinning zone (from the tip of spinneret to collector) for the cylinder spinneret (FIG. 20*a*) and the disc spinneret 114 (FIG. 20*b*) calculated using finite element analysis (using FEMLAB3.4). The disc spinneret 114 has a different electric field profile to the cylinder spinneret. The field lines around the disc spinneret were concentrated on the peripheral edge area. However, electric field on the cylinder concentrated on the cylinder ends. Jet initiation leading to nanofibre formation is strongly influenced by the electric field intensity around a spinnerets surface. The electric field intensity along the cylinder surface is higher at the cylinder ends and reduces gradually toward the middle surface area. The higher electric field intensity at cylinder end than in the middle cylinder surface could be the main reason for that the jets/filaments were generated only from the ends of cylinder surface when the applied voltage was low. Similar to the cylinder surface, the electric field intensity on the disc surface of the disc spinneret 114 decayed from the top of the disc toward the liquid surface. With the increase in the applied voltage, the electric field intensity increased on the entire surface.

Conclusion

PVA nanofibres can be electrospun from the surface of a rotating metal disc. During electrospinning, nanofibres were mainly produced from the edge area, and the voltage for initiating the electrospinning process was 42 kV (PVA, 9 wt %). With an increase in the applied voltage, the disc-spun nanofibres became finer with a narrower diameter distribution. Under the same conditions, nanofibres generated from the disc spinneret were finer than those produced by a cylinder spinneret. Furthermore, the electrospinning production rate of a disc spinneret is similar to a cylinder spinneret of the same diameter.

Example 4

Multiple Disc/Coil Spinneret

Multidisc Setup

Figure 21:
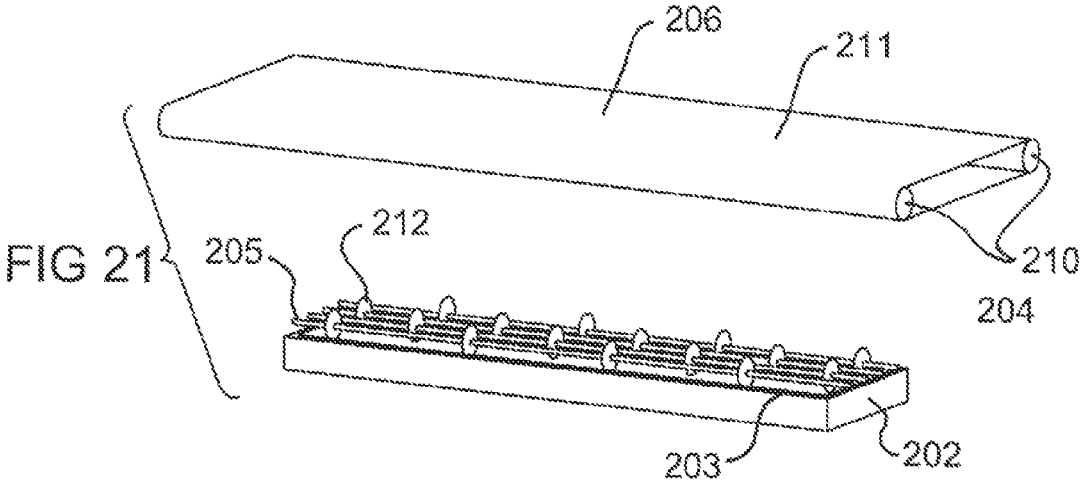
FIG. 21 provides a schematic view of a multi-disc electrospinning setup according one embodiment of the present invention.

Referring to FIG. 21, there is shown an electrospinning apparatus that includes a charged multidisc spinneret 204, a container 202 for polymer solution 203, and counter electrode 206. It should be understood that a high voltage power supply power supply (not shown) would be connected between the spinneret 204 and counter electrode 206. The counter electrode 206 includes two spaced apart metallic drums 210 and belt 211 positioned above and lengthwise parallel with the spinneret 204.

As illustrated, the spinneret 204 contains a plurality of rotatable fibre generators comprising metal discs 212. The distance between each two adjacent discs 212 along the shaft 205 is 15 cm. The distance between two adjacent shafts (central axis) is 55 cm. The diameter and thickness of the discs 212 are 80 cm and 2 mm, respectively.

Experimental Results

During electrospinning, viscous PVA solution (similar to the solution described in the previous examples) was loaded on the surface of the disc spinneret 204 by slow rotation of the discs 212. A high voltage was then applied between the polymer solution 203 and the collector 206 to form a plurality of polymer jets on the top surface of the discs 212.

The formation of jets/filaments was found to be mainly influenced by the applied voltage and the polymer concentration of the polymer solution 203.

Multiple Spiral-Coils

Figure 22:
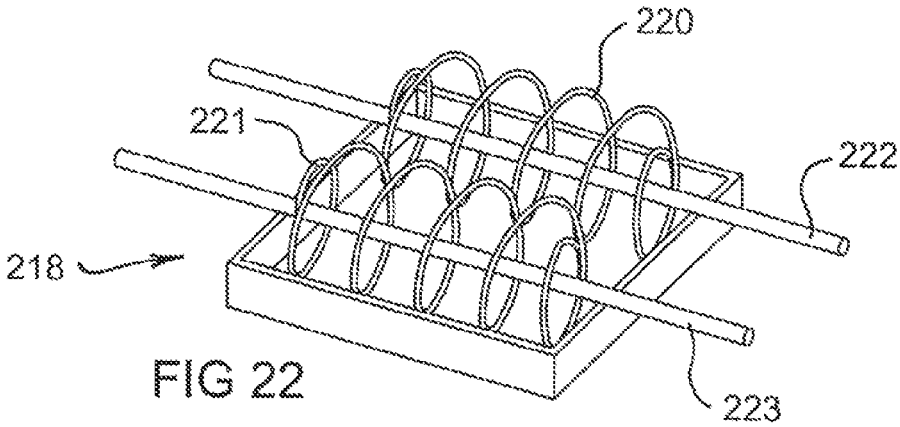
FIG. 22 provides a schematic view of a multi-coil electrospinning setup according one embodiment of the present invention.

A spinneret 218 can also include more than one tubular coil to increase the productivity of the electrospinning apparatus. A two coil setup is illustrated in FIG. 22. The illustrated spinneret 218 includes two tubular coils 220, 221 each mounted on a separate central axle 222, 223. The central axles 222, 223 are radially spaced apart by a distance of from the coil radius to 10 times of the coil radius. The coils can rotate either in the same direction or opposite direction.

This spinneret 218 operates in an electrospinning apparatus in a similar manner as described for a single coil spinneret 12 in relation to the electrospinning apparatus 10 shown in FIGS. 1 and 2.

Example 5

Air Flow Enhanced Electrospinning

Experimental Setup

Figure 23:
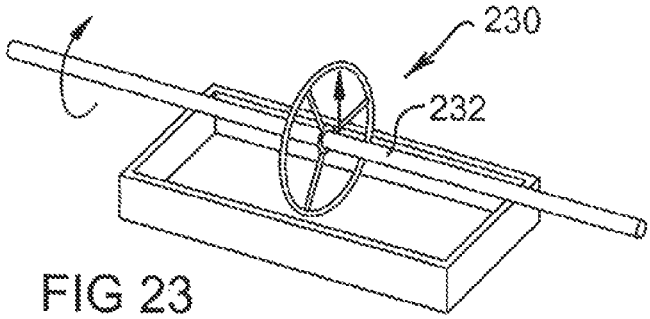
FIG. 23 provides a schematic view of an air flow enhanced electrospinning setup according to one embodiment of the present invention.

The basic spinneret 230 air flow setup is illustrated in FIG. 23. This spinneret 230 operates in a spinneret 218 in an electrospinning apparatus in a similar manner as described for the disc spinneret 114 in the electrospinning apparatus 110 shown in FIG. 16. However, in this setup a tubular nozzle 232 is included in the electrospinning zone which directs air flow in the direction from the spinneret 230 to the counter electrode (not shown but located generally above the spinneret 230).

In this set up, air flow is used to enhance electrospinning. An air flow can be applied from the nozzle 232 or other area around the electrospinning setup, with the air flow direction from the fibre generator (in this case ring spinneret 230) to the collector (not shown). The overall rate of the air flow is generally in the range between 60 ml/min and 6 L/min, depending on the length and structure of spinneret 230.

Experimental Results

Figure 24:
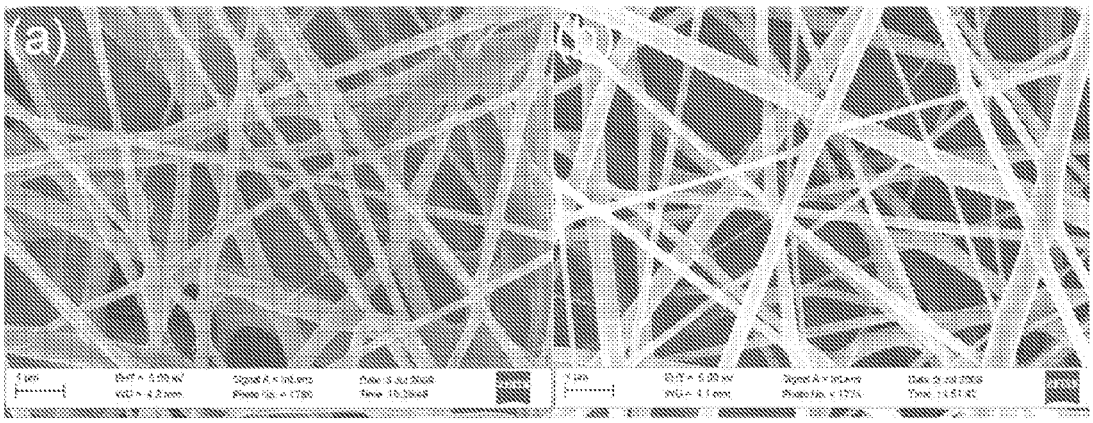
FIG. 24 is FIG. 3 SEM images of nanofibres electrospun by the apparatus shown in FIG. 23 (*a*) without air flow; and (*b*) with air flow, at an air flow rate of 120 ml/min.

FIG. 24 shows the morphology of nanofibres electrospun from the apparatus shown in FIG. 23 with (FIG. 24(*a*)) and without (FIG. 24(*b*)) the presence of an air flow from the tubular nozzle 232.

Without the presence of air flow (FIG. 24(*a*)), the collected fibres could bridge each other because of the insufficient solvent evaporation during electrospinning, leading to an interconnected fibrous structure.

However, when the air flow was applied (FIG. 24(*b*)), the collected fibres appear more isolated.

Figure 25:
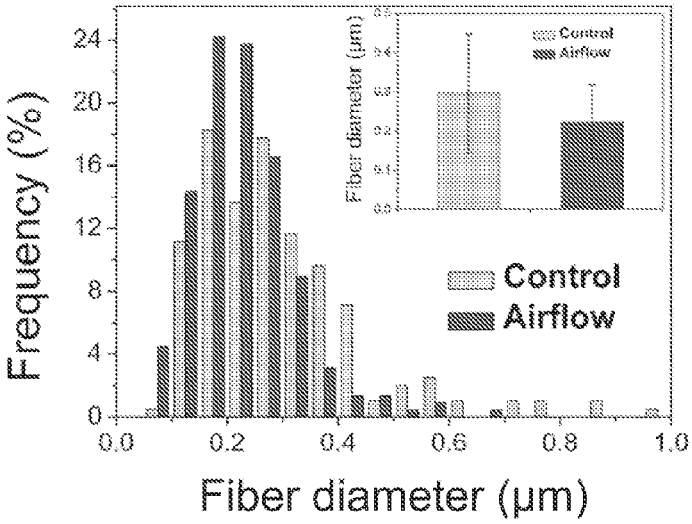
FIG. 25 provides a plot of the fibre diameter and distribution for experimental runs using the apparatus shown in FIG. 23.

The air flow also influences fibre diameter. As shown in FIG. 25, air flow enhanced electrospinning results in finer fibres with a narrower diameter distribution.

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. An electrostatic spinning apparatus for producing nanofibres from a viscous liquid in an electric field comprising:

a charged electrode including at least one spinneret including a plurality of annular loops radially centred about and axially spaced along a central axis, wherein the annular loops are integrally connected to form a helical coil;

a counter electrode spaced apart from the charged electrode;

a liquid reservoir for holding a viscous liquid, the reservoir being in liquid communication with at least one surface of the spinneret; and a power supply electrically connected between the charged electrode and the counter electrode, the power supply capable of electrically charging the charged electrode and supply a potential difference between the charged electrode and the counter electrode, wherein the liquid reservoir comprises a liquid bath in which a portion of the spinneret is immersed, the spinneret being configured to rotate about the center axis (X-X) in order to coat a portion of the viscous liquid on a surface of the spinneret and move that coated surface out from the liquid reservoir.

2. An electrostatic spinning apparatus according to claim 1, wherein the coil comprises a tubular shaped coil radially centred about the central axis.

3. An electrostatic spinning apparatus according to claim 2, wherein the radius of annular loops of the spinneret at and/or proximate the end of the tubular shaped coil are smaller than the annular loops proximate the center of the tubular shaped coil.

4. An electrostatic spinning apparatus according to claim 1, wherein the spinneret has at least one of the following properties:

the average radius of the annular loops being between 5 and 1000 mm;

the length of the coil being greater than 2 mm;

the diameter of the wire of the coil being between 0.5 mm and 200 mm; or the spacing (d) between adjacent annular loops is at least 1 mm.

5. An electrostatic spinning apparatus according to claim 1, in which the spinneret includes at least one of the following properties:

the length of the coil being between 20 and 6000 mm;

the diameter of the wire of the coil being between 0.7 and 50 mm; or the spacing between adjacent annular loops is between 5 mm and 800 mm.

6. An electrostatic spinning apparatus according to claim 1, wherein each annular loop of each spinneret is spaced closely to an adjacent annular loop relative to the central axis so as to form an aperture between each adjacent annular loop, the spacing between the loops being selected to enable surface forces of viscous liquid to retain that liquid between the loops when an electric field between the spinneret and a counter electrode is less than a critical intensity.

7. An electrostatic spinning apparatus according to claim 1, wherein the counter electrode is orientated parallel to the central axis of the spinneret.

8. An electrostatic spinning apparatus according to claim 1, wherein the counter electrode extends along the length of the spinneret.

9. An electrostatic spinning apparatus according to claim 1, wherein the counter electrode includes a rotating tubular body on which the nano-fibre product can be collected.

10. An electrostatic spinning apparatus according to claim 1, further including at least two spinnerets, each of the spinnerets including a central axis, the respective central axis of each spinneret being radially spaced apart relative to one another.

11. An electrostatic spinning apparatus according to claim 1, wherein the power supply creates a potential difference between the charged electrode and the counter electrode of greater than 30 kV.

12. An electrostatic spinning apparatus according to claim 1, wherein the charged electrode is spaced apart from the counter electrode by between 100 to 600 mm.

13. An electrostatic spinning apparatus according to claim 1, wherein the viscous liquid is a polymer solution.

14. An electrostatic spinning apparatus according to claim 1, further including a fluid source with an outlet located proximate the spinneret, the fluid source having a fluid flow directed to flow from the spinneret to the counter electrode.

* * * * *